United States Patent [19]

Egoshi et al.

[11] Patent Number: 5,033,530

[45] Date of Patent: Jul. 23, 1991

[54] HIGH PRESSURE CASTING SAND CORE AND METHOD OF MANUFACTURING OF THE SAME

[75] Inventors: Yoshiaki Egoshi; Jyoji Umeda; Yasuhiro Sugioka, all of Fuchu, Japan

[73] Assignee: Ryobi Limited, Japan

[21] Appl. No.: 481,191

[22] Filed: Feb. 20, 1990

[30] Foreign Application Priority Data

Feb. 20, 1989 [JP] Japan ..... 1-41192

[51] Int. Cl.[5] ..... B22C 9/10; B22D 33/04

[52] U.S. Cl. ..... 164/30; 164/137; 164/340

[58] Field of Search ..... 164/131, 132, 137, 30, 164/228, 230, 345, 340

[56] References Cited

U.S. PATENT DOCUMENTS

| | | | |
|---|---|---|---|
| 1,659,837 | 2/1928 | Ryan | 164/30 |
| 2,637,071 | 5/1953 | Williams | 164/340 |
| 2,696,031 | 12/1954 | Fouron | 164/340 |
| 2,948,031 | 8/1960 | Webb | 164/340 |
| 4,462,455 | 7/1984 | Henych | 164/340 |
| 4,951,731 | 8/1990 | Downing | 164/14 |

FOREIGN PATENT DOCUMENTS

| | | | |
|---|---|---|---|
| 145507 | 12/1980 | Fed. Rep. of Germany | 164/137 |
| 55-144352 | 1/1980 | Japan . | |
| 6069152 | 10/1983 | Japan . | |
| 60-15041 | 1/1985 | Japan | 164/137 |
| 62110856 | 11/1985 | Japan . | |
| 61-1446 | 1/1986 | Japan | 164/30 |

*Primary Examiner*—Richard K. Seidel
*Assistant Examiner*—Rex E. Pelto
*Attorney, Agent, or Firm*—Oliff & Berridge

[57] ABSTRACT

A sand core adapted for high pressure casting is formed by a core body and a support pin to be connected to the core body. The support pin is provided with one end portion to be embedded in said core body and the other end portion projected outwardly from the core body. A connecting means is formed to the embedded portion so as to integrally connect the core body and the support pin and a support pin positioning and supporting means is formed at the projecting portion of the support pin. Positioning pins extending from a core formation mold are engaged with the positioning and supporting means so that the embedded end portion of the support pin is positioned in the cavity of the core formation mold. The cavity is filled with core sand whereby the embedded one end of the support pin is supported to integrally form the support pin and the core body. The sand core is dipped in a slurry including a sand core coating material and then heated and dried.

9 Claims, 4 Drawing Sheets

HIGH PRESSURE CASTING SAND CORE AND METHOD OF MANUFACTURING OF THE SAME

BACKGROUND OF THE INVENTION

The present invention relates to a sand core adapted for a high pressure casting performed by a die casting machine utilized for forming a hollow portion in a hollow metal head of a golf club shaft, for example, or other cast products and also relates to a method of manufacturing such a sand core.

In this art field, there have been provided various kinds of cores, such as (1) a core in which a pipe piece is disposed for positioning the core in a mold at the time of compression formation and casting (Japanese Patent Laid-open Publication No. 55-144352), (2) a core in which a back metal of a hollow pipe structure is closely fitted in a hollow portion of the sand core for reinforcing the same and a cutout groove is formed for positioning the sand core in a mold (Japanese Patent Laid-open Publication No. 62-110856) and (3) a core which is supported in a casting mold by a rod-like member having a small diameter and a molten metal is casted in a casting mold to integrally form the sand core. The rod-like member is finally removed (Japanese Utility Model Laid-open Publication No. 60-69152).

However, in the case of cores described by the above (1) and (2) in which the pipe piece or the back metal is forcibly pushed or fitted in the core after the formation of the core body, the cores are liably broken when the pipe piece is forcibly inserted or the back metal is tightly fitted in the core and it is difficult to accurately position and set the pipe piece or the back metal with respect to the core. In addition, the manufacturing method includes a pipe piece or back metal setting process in addition to the core formation process to increase the additional step and, hence, resulting in the cost up of the manufacture thereof.

On the other hand, in the case of the core manufacturing method described by the above (3), since the rod-like member is liably damaged at a time when the core is formed, the core is removed from the formation mold, or the core is placed on the table, for example, thus being inconvenient for handling the same. Moreover, the surface of the core is also liably damaged when the core is placed on the table, and the rod-like member may be damaged when the member is placed in the core or broken by a pressure of a molten metal at a time of die casting, resulting in the fault of a cast product. In addition, in this method, the core is positioned and supported only by means of the rod-like member, so that the positioning of the core is not made accurately. Since the removal of the sand in the core is performed through the inner hollow portion of the rod-like member, it is difficult to completely remove the sand and, hence, a heat treatment is required for the removal of the sand.

SUMMARY OF THE INVENTION

An object of the present invention is to substantially eliminate the defects or drawbacks encountered to the prior art described above and to provide a high pressure casting sand core capable of being accurately placed in a mold by utilizing positioning pins located in the mold, being free from damaging due to the pressure of a molten bath to be poured, and easily removing the sand after the casting process. Another object of the present invention is to provide a method of manufacturing the sand core which is excellent in the strength and convenient for handling the sand core at a time of forming and coating the same.

This and other objects can be achieved according to the present invention, in one aspect, by providing a sand core adapted for high pressure casting for forming an inner hollow portion of a cast product comprising a core body, a support pin in shape of a solid rod, the support pin being provided with one end portion to be embedded in the core body and the other end portion projected outwardly from the core body, means provided on the embedded one end portion of the support pin for integrally connecting the support pin and the core body, and means provided on the projected other end portion of the support pin for positioning and supporting the support pin with respect to the core body.

In a preferred embodiment, the connecting means is at least one hole formed at the end portion of the support pin embedded in the core body and the positioning and supporting means also comprises at least one hole, preferably two or more than two, formed at the other end portion of the support pin.

In another aspect according to the present invention, there is provided a method of manufacturing a sand core adapted for high pressure casting comprising the steps of preparing a support pin with means for connecting a core body with the support pin and means for positioning and supporting the support pin with respect to a core formation mold and/or a die casting mold; setting the support pin in the core formation mold with an inner cavity corresponding to a core body in such a manner that one end portion having the connecting means, of the support pin is located in the inner cavity and that a positioning pin of the core formation mold is engaged with the positioning and supporting means formed on the other end of the support pin; filling the inner cavity with core sand to integrally form the support pin and the core body; dipping the core body into a slurry including a sand core coating material; and heating and then drying the core body.

According to the present invention of the characters described above, the core body and the support pin are integrally formed, so that the core body is never suffered from a damage after the molding of the core body which is liable in case of forcibly inserting the support pin such as in the prior art and, moreover, the positioning of the support pin can be made accurately. The connecting portion between the core body and the support pin is formed at a portion to be embedded in the core body and the positioning and supporting portion is formed at a portion of the support pin projecting outwardly from the core body, whereby the core body and the support pin can be tightly integrated and the positioning of the core body and the support pin in the mold can be also accurately made. Further, the damage and breakage of the support pin due to the pressure of the molten metal to be poured can be effectively prevented. The usage of such support pin allows the core body to be easily and accurately handled in molding, coating and storage thereof.

DESCRIPTION OF THE PREFERRED EMBODIMENT

Figure 1:
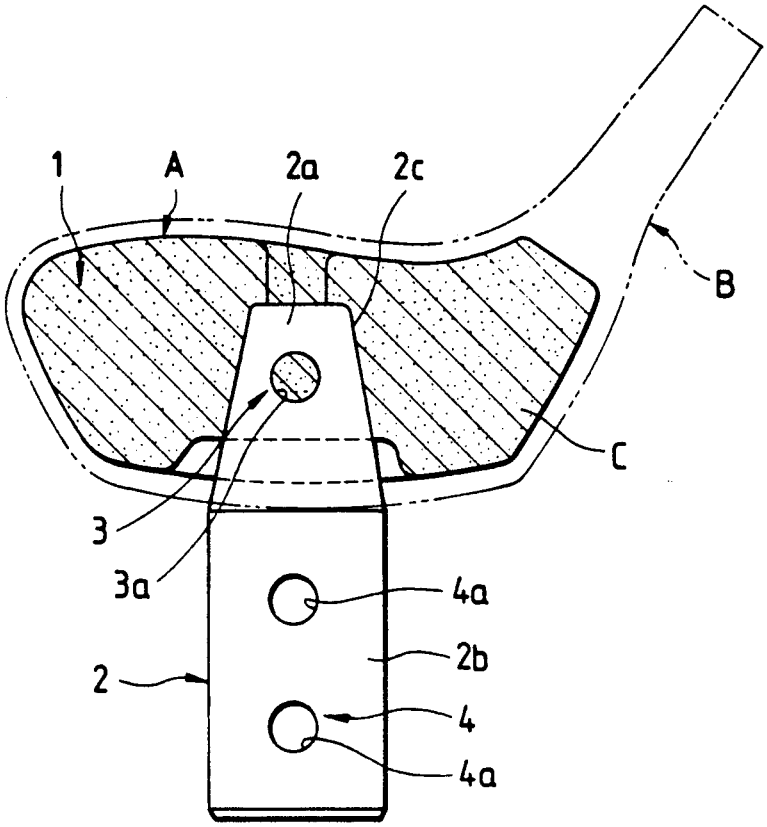
FIG. 1 is an elevational front view of one embodiment of a high pressure casting sand core according to the present invention.

Referring to FIG. 1, a sand core A is utilized for forming a hollow portion C of a cast product B and comprises a core body 1 constituting a main body of the sand core A and a support pin 2 in a shape of a solid rod having one end embedded in the core body 1 and the other end extending outwardly from the core body 1. The support pin 2 is made of metal such as light metal and iron series metal.

Figure 2A:
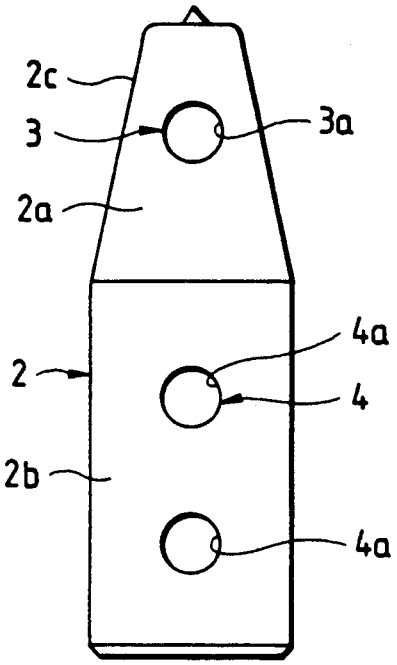
FIGS. 2A, 2B, 2C, and 2D are front views of various examples of support pins utilized for the formation of the sand core shown in FIG. 1, respectively.
Figure 2B:
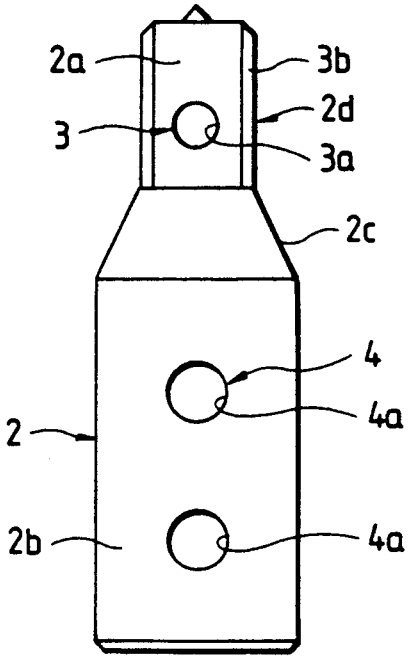

As described, the support pin 2 is composed of a portion 2*a* embedded in the core body 1 and a portion 2*b* projecting outwardly from the core body 1. A connecting means 3 for tightly integrating the support pin 2 with the core body 1 is provided for the embedded portion 2*a* of the support pin 2. The connecting means 3 may be formed as at least one sand receiving through hole 3*a* such as shown in FIG. 1 or FIG. 2A or 2B. The sand receiving hole 3*a*, as shown, is formed so as to be horizontally opened with a right angle with respect to the axis of the support pin 2, but the hole may be formed as a bottomed hole having a proper depth.

The object for the location of the sand receiving hole 3*a* is to obtain a strong connecting force between the core body 1 and the support pin 2 by filling the hole with the core sand of the core body and hardening the core sand. Accordingly, it may be desired to form the embedded portion 2*a* so as to have a front tapered shape to easily remove the support pin 2 from the core body 1 after the molding of the cast product B which is molded by utilizing the sand core A as described hereinafter.

Figure 2C:
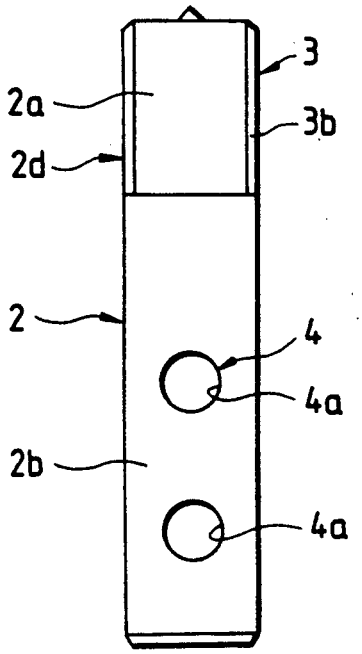
Figure 2D:
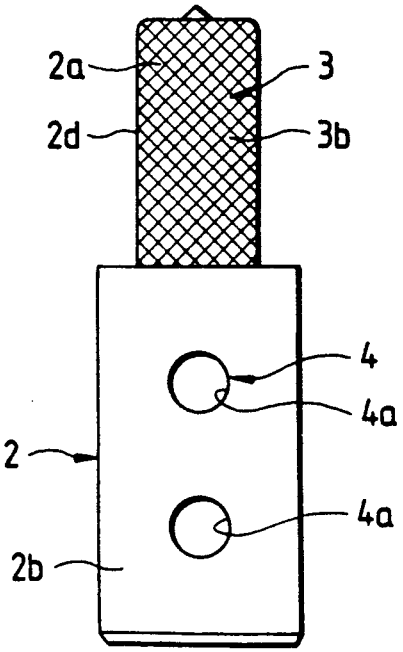

The connecting means 3 may be formed as a screw (spiral) thread (male screw) or knurling recessed and protruded portion 3*b* on the outer peripheral surface of the embedded portion 2*a* as shown in FIG. 2B, 2C or 2D. The embedded portion 2*a* has a cylindrical or rectangular shape.

Furthermore, as shown in FIG. 2B, the embedded portion 2*a* may be formed as a combination of the tapered portion 2*c* and the parallelled portion 2*d*, and the connecting means 3 may also be formed as a combination of the sand receiving hole 3*a* and the recessed and protruded threads 3*b*.

The projecting portion 2*b* is provided with a positioning and supporting means 4.

Figure 3:
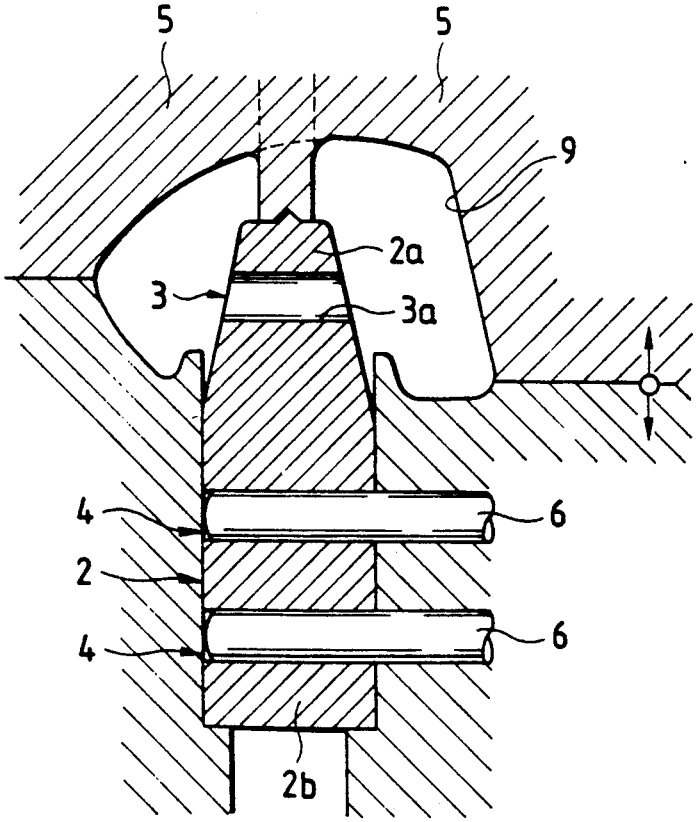
FIG. 3 is an elevational section of a mold in which the support pin is set.
Figure 5:
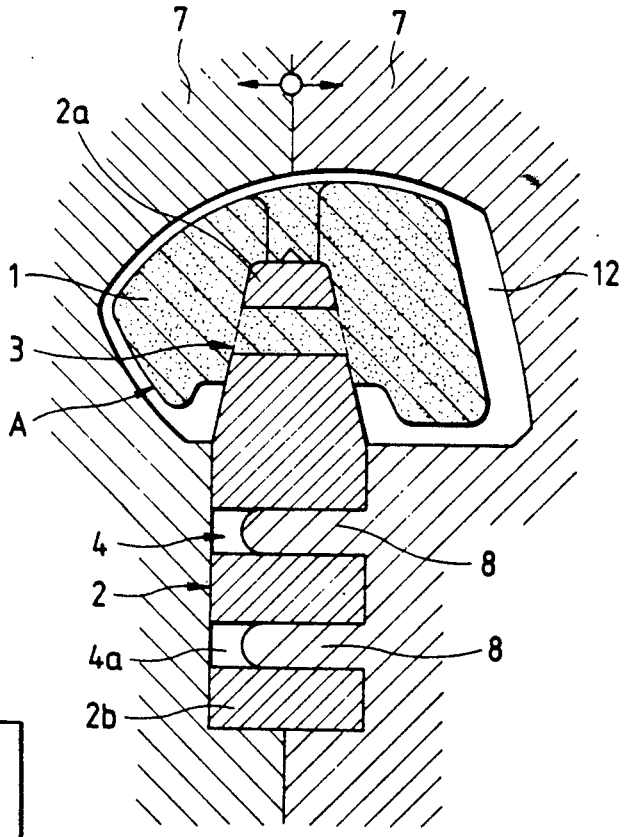
FIG. 5 is an elevational side view showing a setting condition of the sand core in a die casting mold.

The positioning and supporting means 4 is formed as at least one, preferably two or more than two, engaging holes 4*a* and 4*a* (two in the illustrated embodiment), which are engaged with positioning pins 6 and 6 projected from a core formation mold 5 as shown in FIG. 3 for positioning and support the supporting pin 2 in the mold 5 at a time when the sand core A is formed. The holes 4*a* are also engaged with projecting pins 8 and 8 projected form a die casting mold 7 as shown in FIG. 5 for positioning and supporting the support pin 2 in the die casting mold 7 at a time when the cast product B is formed by using the sand core A.

Figure 4:
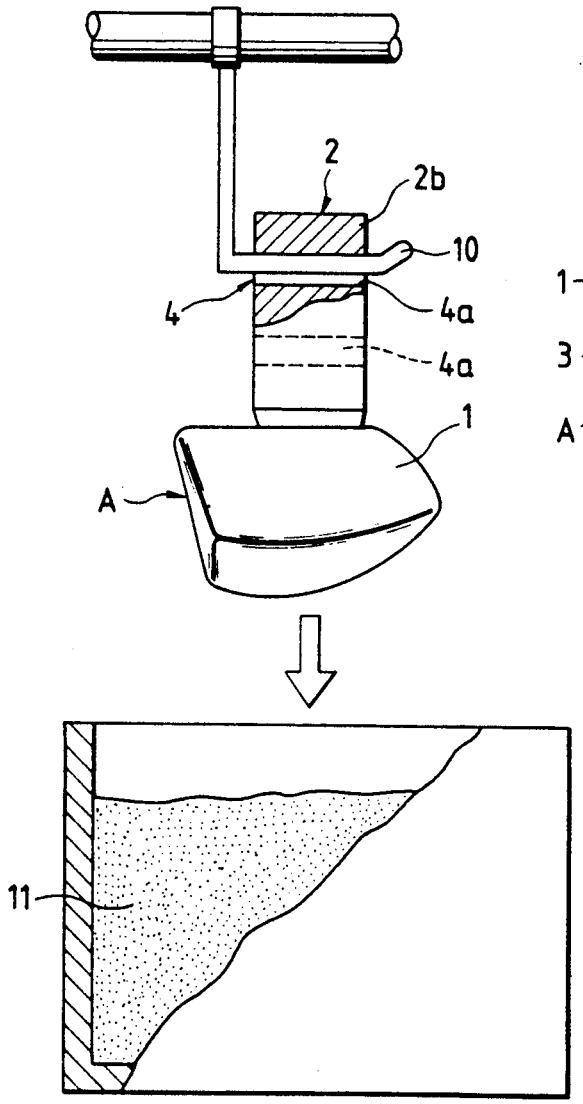
FIG. 4 is a side view, partially cut away, showing a coating condition of the sand core of the embodiment shown in FIG. 1.

The sand core A described above will be manufactured according to the present invention by the following manner which will be described with reference to FIGS. 3 and 4.

1. First Process (FIG. 3)

The positioning pins 6 and 6 projected from the core formation mold halves 5 and 5 are engaged with the positioning and supporting means 4 formed as holes in the projecting portion 2*b* of the support pin 2. The support pin 2 is supported and positioned in the core formation mold halves 5 and 5 so that the portion 2*a* of the support pin 2 is disposed in the cavity 9 of the mold halves. The cavity 9 is filled with the core sand, whereby the core body 1 and the support pin 2 are integrally formed.

2. Second Process (FIG. 4)

The mold halves 5 and 5 are opened after the core body 1 has been solidified and the core is taken out. The positioning and supporting means 4 of the support pin 2 of the sand core A molded by the first process is then engaged with a hook member 10. The core body 1 is then dipped in a slurry 11 including a sand core coating material.

3. Third Process

The core body 1 after the second process is heated in a heating furnace and then dried.

The formation of the cast product B by the die casting method by using the sand core A according to the present invention will be described with reference to FIGS. 5 and 6.

As shown in FIG. 5, the positioning pins 8 and 8 projected from the die casting mold half 7 are inserted into the positioning and supporting means 4 of the support pin 2 and the mold halves 7 are clamped. Thereafter, the sand core A is disposed in position in the die casting mold halves 7 and 7 and molten metal such as aluminum alloy is supplied into the cavity 12. After the solidification of the molten metal, the mold halves 7 are opened to take out the cast product B.

Figure 6:
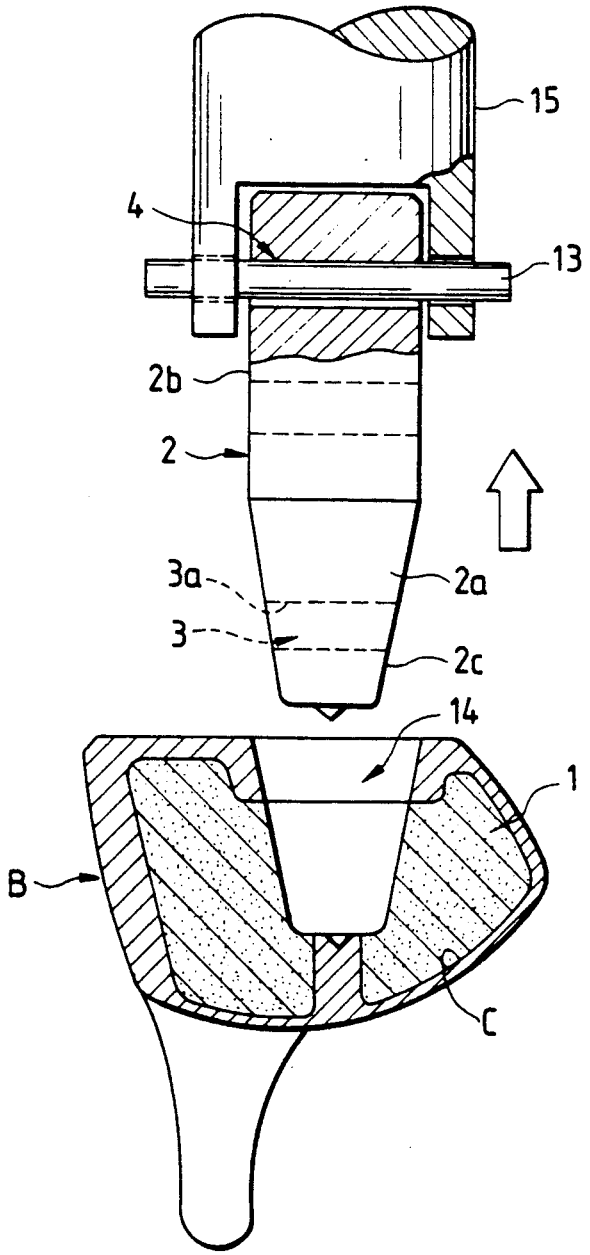
FIG. 6 is an elevational side view showing a condition in which the support pin is drawn out from the core body after the formation of a cast product by utilizing the sand core according to the embodiment of the present invention.

As shown in FIG. 6, a pin 13 of a jig 15 for removing the support pin 2 is engaged with the positioning and supporting means 4 of the support pin 2 to draw out the support pin 2 from the core body 1 in an arrowed direction. The cavity 14 formed by removing the support pin 2 is directed downwardly and the cast product B is then vibrated to completely drop down the sand in the cavity 14, whereby a final cast product B provided with the cavity C is formed.

As described hereinabove, according to the present invention, the core body 1 and the support pin 2 are integrally formed, so that the core body 1 is hardly damaged at a time of arranging the support pin 2 and, hence, the core body 1 can be exactly positioned. The positioning and supporting of the sand core A at a time when a cast product B is casted by the die casting method by the use of the sand core A can be easily and accurately performed by the suitable engagement between the projecting portions 8 projected from the mold halves 7 and the positioning and supporting means 4 formed in the projecting portion 2*b* of the support pin 2. Since the support pin 2 is made of a metal of high strength, the support pin is not damaged by the pressure of the molten metal during the die casting process.

Since the support pin 2 is firmly integrated by the engagement between the connecting means 3 and the embedded portion 2a of the support pin 2, the sand core can be easily and accurately handled when the core is formed and coated. These advantages can be enhanced by the various modifications of the connecting means to increase the connecting strength between the core body 1 and the support pin 2. The positioning and supporting of the support pin 2 and the sand core A in the mold can be improved by the engagement between the positioning pins and the positioning and supporting means 4 formed in the support pin 2. The sand can be easily removed by the utilization of a cavity formed by the removal of the support pin 2 from the core body 1, which eliminates an additional heat treatment for the removal of the sand.

According to the sand core manufacturing method of the present invention, the surface of the core body 1 is hardly damaged and, hence, can be finely coated. The sand core substantially free from damaging and breaking at times of forming, coating, handling, and die casting can be manufactured and the method is performed substantially by one process with reduced cost.

What is claimed is:

1. A sand core adapted for high pressure casting for forming an inner hollow portion of a cast product comprising:

a core body;

a support pin in a shape of a solid rod, said support pin being provided with one end portion embedded in said core body and the other end portion projected outwardly from said core body;

connecting means for integrally connecting the support pin and the core body, said connecting means being comprised of at least one sand receiving hole formed in the embedded one end portion of said support pin; and positioning and supporting means for positioning and supporting said support pin with respect to at least one of a core formation and a die casting mold, said positioning and supporting means being comprised of at least one engaging hole formed in the projected other end portion of said support pin.

2. A sand core according to claim 1, wherein said support pin is made of a metal material.

3. A sand core according to claim 2, wherein said metal material is a light metal.

4. A sand core according to claim 2, wherein said metal material is an iron series material.

5. A method of manufacturing a sand core adapted for high pressure casting comprising the steps of:

preparing a support pin with means for connecting a core body with the support pin and means for positioning and supporting the support pin with respect to at least one of a core formation mold and a die casting mold;

setting the support pin in the core formation mold with an inner cavity corresponding to a core body in such a manner that one end portion having the connecting means of the support pin is located in the inner cavity said connecting means being comprised of at least one sand receiving hole formed in an embedded one end portion of said support pin and further setting the support pin in the core formation mold in such a manner that a positioning pin of the core formation mold is engaged with the positioning and supporting means formed on the other end of the support pin;

filling the inner cavity with core sand to integrally form the support pin and the core body;

dipping the core body into a slurry including a sand core coating material; and heating and then drying the core body.

6. A method according to claim 5, wherein the positioning and supporting means of the support pin of the sand core is engaged with a hook member and the core body is then dipped in a slurry including a sand coating material.

7. The method of claim 5, wherein the inner cavity is filled such that the core sand fills said hole provided in the one end portion of the support pin located in the inner cavity.

8. A sand core adapted for high pressure casting for forming an inner hollow portion of a cast product comprising:

a core body;

a support pin in a shape of a solid rod, said support pin being provided with one end portion embedded in said core body and the other end portion projected outwardly from said core body;

connecting means for integrally connecting the support pin and the core body, said connecting means formed as a spiral thread and comprising at least one sand receiving hole formed in the embedded one end portion of said support pin; and positioning and support means for positioning and supporting said support pin with respect to at least one of a core formation and a die casting mold, said positioning and supporting means being comprised of at least one engaging hole formed in the projected other end portion of said support pin.

9. A sand core adapted for high pressure casting for forming an inner hollow portion of a cast product comprising:

a core body;

a support pin in a shape of a solid rod, said support pin being provided with one end portion embedded in said core body and the other end portion projected outwardly from said core body;

connecting means for integrally connecting the support pin and the core body, said connecting means being formed as a knurling recessed and protruded thread comprising at least one sand receiving hole formed in the embedded one end portion of said support pin; and positioning and support means for positioning and supporting said support pin with respect to at least one of a core formation and a die casting mold, said positioning and supporting means being comprised of at least one engaging hole formed in the projected other end portion of said support pin.

* * * * *